US010471973B2

(12) United States Patent
Seavey

(10) Patent No.: US 10,471,973 B2
(45) Date of Patent: Nov. 12, 2019

(54) CABLE STAY TRANSPORT VEHICLE AND INSPECTION SYSTEM AND RELATED METHODS

(71) Applicant: INFRASTRUCTURE PRESERVATION CORPORATION, Clearwater, FL (US)

(72) Inventor: William Seavey, Clearwater, FL (US)

(73) Assignee: INFRASTRUCTURE PRESERVATION CORPORATION, Clearwater, FL (US)

( * ) Notice: Subject to any disclaimer, the term of this patent is extended or adjusted under 35 U.S.C. 154(b) by 246 days.

(21) Appl. No.: 15/491,520

(22) Filed: Apr. 19, 2017

(65) Prior Publication Data

US 2018/0057021 A1 Mar. 1, 2018

Related U.S. Application Data

(60) Provisional application No. 62/378,913, filed on Aug. 24, 2016.

(51) Int. Cl.

| | |
|---|---|
| ***B61D 15/12*** | (2006.01) |
| ***B61B 12/12*** | (2006.01) |
| ***E01D 19/10*** | (2006.01) |

(52) U.S. Cl.

CPC ..... *B61D 15/125* (2013.01); *B61B 12/12* (2013.01); *E01D 19/106* (2013.01)

(58) Field of Classification Search

CPC ..... B61D 15/00; B61D 15/08; B61D 15/12; G01N 27/00; G01N 27/22; G01N 27/24

See application file for complete search history.

(56) References Cited

U.S. PATENT DOCUMENTS

| | | | | |
|---|---|---|---|---|
| 7,496,454 | B2 | 2/2009 | Rogers et al. | |
| 8,526,706 | B2 | 9/2013 | Verreet | |
| 8,614,707 | B2 | 12/2013 | Warsito et al. | |
| 8,660,698 | B2 | 2/2014 | Phillips et al. | |
| 9,075,023 | B2 | 7/2015 | Yoshioka et al. | |
| 9,371,960 | B2 * | 6/2016 | Lorimer | H02G 1/02 |

(Continued)

FOREIGN PATENT DOCUMENTS

| | | | |
|---|---|---|---|
| JP | 2013-245496 | A | 12/2013 |
| KR | 10-2010-0047926 | A | 5/2010 |

(Continued)

*Primary Examiner* — Robert J McCarry, Jr.

(74) *Attorney, Agent, or Firm* — Matthew G. McKinney, Esq.; Allen, Dyer et al.

(57) ABSTRACT

A cable stay transport vehicle and inspection system having an upper frame coupled to a spaced apart lower frame. The transport vehicle is configured to be secured around a cable stay. The transport vehicle includes left upper and lower sets of wheels secured between left side upper and lower frames, and right upper and lower sets of wheels secured between right side upper and lower frames. In addition, a left steering device is coupled between the left upper and lower sets of wheels and includes a left steering gear, and a right steering device coupled to the right upper and lower sets of wheels and comprising a right steering gear. Left and right driving gears are coupled to the left and right steering gears, respectively, and are configured to engage the respective steering gear to turn the transport vehicle when activated.

11 Claims, 7 Drawing Sheets

(56) References Cited

U.S. PATENT DOCUMENTS

| | | | | |
|---|---|---|---|---|
| 9,665,932 | B2 | 5/2017 | Lauffer et al. | |
| 2013/0085365 | A1 | 4/2013 | Marashdeh et al. | |
| 2016/0161436 | A1* | 6/2016 | Marashdeh ..... | G01N 27/24 324/681 |
| 2017/0180612 | A1 | 6/2017 | Marashdeh et al. | |

FOREIGN PATENT DOCUMENTS

| | | | |
|---|---|---|---|
| KR | 10-2013-0032076 | A | 4/2013 |
| KR | 10-01480118 | B1 | 1/2015 |

* cited by examiner

CABLE STAY TRANSPORT VEHICLE AND INSPECTION SYSTEM AND RELATED METHODS

FIELD

The present invention relates to the field of bridge structures, and, more particularly, to a cable stay transport vehicle and inspection system and related methods.

BACKGROUND

Tubular tension support lines known as cable stays provide the upward support for a bridge that extends beyond the distance that can be self-supported by a horizontal structure. The cable stays can deteriorate or develop physical flaws over time and must be visually inspected periodically. The vertical structure that supports the cable stays is called a pier and the connection between the cable stay and the pier is called the anchor point.

The anchor point and cable stay can pull away from the pier and thus requires periodic inspections. The cable stays are typically five to eight inches in diameter. The cable stays are constructed as diagonal mounted cables that connect the vertical support pier to the horizontal deck. The cable stays have steel tendons inside and are filled with a cement mixture known as grout or some other chemical or material that can protect the internal steel. The condition of the exterior of the cable stays can indicate a more serious flaw and is one of the focuses of the inspection.

One existing means of inspection involves a person in a bucket truck or a person climbing up the cable stay and visually inspecting it. While this is slow and tedious, it also can lead to missed flaws and is dangerous to the inspector. Visual inspection from the ground by binoculars or telescope can also have the limitation of the angle and not being able to view the top or opposite side of the cable.

According a need exists for a system to inspect cables stays and the anchor pier connections completely and inexpensively that can be used on multiple types of bridges and cable stays, that is easy to transport between bridges and cables stays, and can provide complete inspection coverage of the cable stays and the cable stay anchor pier connections.

SUMMARY

In view of the foregoing background, it is therefore an object of the present invention to provide a cable stay transport vehicle and inspection system that has the ability to view the full length of the cable stay and provides a 360 degree view of all sides of the cable.

This and other objects, features, and advantages in accordance with the present invention are provided by a cable stay transport vehicle that includes an upper frame coupled to a spaced apart lower frame. The transport vehicle is configured to be secured around a cable stay. Left upper and lower sets of wheels are secured between left side upper and lower frames, and right upper and lower sets of wheels are secured between right side upper and lower frames. A left steering device is coupled between the left upper and lower sets of wheels and includes a left steering gear coupled to a left steering linkage. The left steering linkage has a first end coupled to the left upper set of wheels and a second end coupled to the left lower set of wheels. A right steering device is coupled to the right upper and lower sets of wheels and includes a right steering gear coupled to a right steering linkage. The right steering linkage has a first end coupled to the right upper set of wheels and a second end coupled to the right lower set of wheels. In addition, the transport vehicle includes left and right driving gears coupled to the left and right steering gears, respectively, and are configured to engage the respective steering gear to turn the transport vehicle when activated.

Further, each set of wheels is configured to pivot in response to the respective left and right steering device in order to direct the transport vehicle around a periphery of the cable stay. At least one camera may also be coupled to the transport vehicle and used for the inspection and to transmit images. A power supply may coupled to each set of wheels and the at least one camera. The transport vehicle may also include a spring loaded wheel secured proximate to a lower portion of the transport vehicle and that extends away from the lower frame and is biased to maintain contact with the cable stay.

Remote controls may be in wireless communication with the transport vehicle and configured to control each set of wheels in order to drive the transport vehicle along and around the cable stay using electric motors coupled to each of the set of wheels. In addition, the electric motors may be configured to generate a signal correlating to a distance along the cable stay that the transport vehicle moves in order to determine a particular location of the transport vehicle on the cable stay and a correlating distance along the bridge deck.

In another embodiment, a cable stay transport vehicle includes an upper frame and a spaced apart lower frame, where the transport vehicle is configured to be secured around a cable stay. Left outer and inner connectors connect a left side of the upper frame to a left side of the lower frame, and a left scissor truss connects the left outer and inner connectors in an adjustable spaced apart relation. The transport vehicle also includes right outer and inner connectors that connect a right side of the upper frame to a right side of the lower frame, and a right scissor truss that connect the right outer and inner connectors in an adjustable spaced apart relation. Left upper and lower sets of wheels are secured proximate to upper and lower portions of the left inner connector, respectively, and each set of wheels configured to be rotated to drive the transport vehicle along a length of the cable stay. Similarly, right upper and lower sets of wheels are secured proximate to upper and lower portions of the right inner connector, respectively, and each set of wheels is configured to be driven independently in at least two directions. In addition, the transport vehicle includes a left adjustment bolt coupled to the left outer and inner connectors and which is configured to adjust a distance therebetween. Likewise, a right adjustment bolt may be coupled to the right outer and inner connectors and configured to adjust a distance therebetween. The transport vehicle may also include at least one camera coupled to the transport vehicle that is configured to capture images for the inspection and to maneuver the transport vehicle along and around the cable stay.

In another embodiment, a method to inspect a cable stay includes securing a transport vehicle having an upper frame coupled to a spaced apart lower frame around a cable stay. The method also includes maneuvering the transport vehicle along the cable stay using a remote controlled left steering device coupled between left upper and lower sets of wheels of the transport vehicle, and a right steering device coupled to right upper and lower sets of wheels of the transport vehicle. Each set of wheels is configured to pivot in response to the respective left and right steering device in order to direct the transport vehicle around the cable stay. In addition, the method includes capturing images of the cable stay with a camera coupled to the transport vehicle. The method may also include generating a signal corresponding to a distance of rotation of a particular wheel of the transport vehicle driven by an electric motor, and determining a location of the transport vehicle using the signal.

One advantage of a particular illustrative embodiment of the invention is that the transport vehicle can maneuver or travel up cylindrical vertical and diagonally mounted cable stays that vary in diameter. The transport vehicle also has the ability to generate enough gripping power to maintain traction on a surface that is neither flat and may not be smooth.

Another advantage of the transport vehicle is that it can operate in windy and adverse weather conditions. It also does not require lane closure to operate because there is no need for lifts, and poses virtually no risk to public safety or to the inspector or operator.

Other aspects, advantages, and features of the present disclosure will become apparent after review of the entire application, including the following sections: Brief Description of the Drawings, Detailed Description, and the Claims.

BRIEF DESCRIPTION OF THE DRAWINGS

The aspects and the attendant advantages of the embodiments described herein will become more readily apparent by reference to the following detailed description when taken in conjunction with the accompanying drawings wherein.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
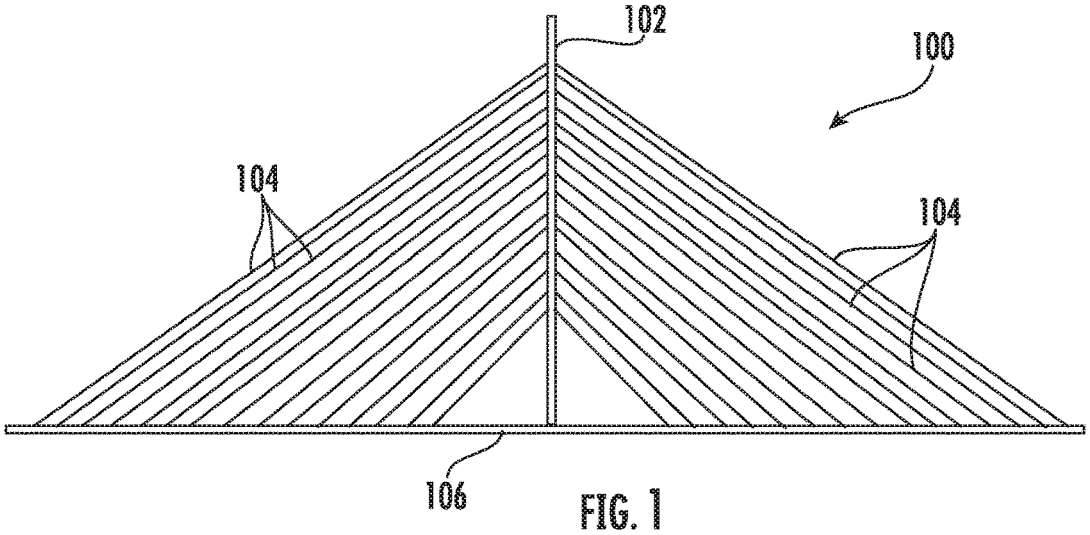
FIG. 1 is an elevational view of a bridge having cable stays for support.
Figure 2:
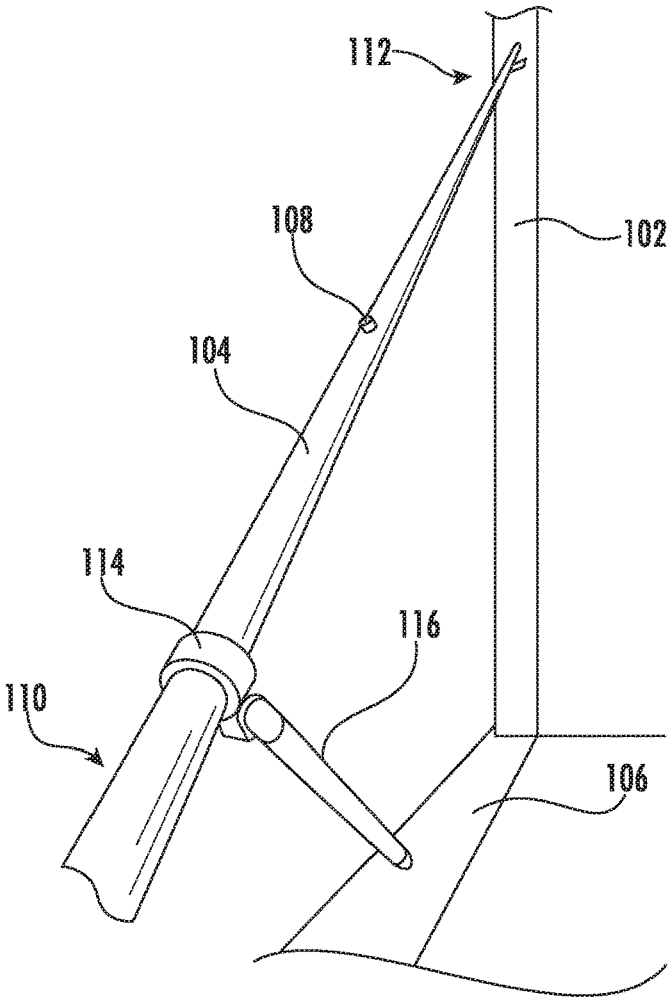
FIG. 2 is a partial detail view of a cable stay shown in FIG. 1.

Referring now to FIGS. 1 and 2, a cable stay bridge structure 100 is shown for reference. In particular, cable stays 104 are connected between a pier 102 and a superstructure 106. The superstructure 106 is used to support the bridge deck. The cable stays 104 each have an upper portion that connects to the pier 102 and a lower portion that connects to the superstructure 106.

The cable stays 104 are hollow tubular members with steel cables and are filled with grout using grout ports 108 that are dispersed along a length of each of the cable stays 104. The grout ports 108 protrude outward from the cable stays 104. In addition, there are band couplers 114 that are used to connect struts 116 between the cable stays 104 and the superstructure 106.

Figure 3:
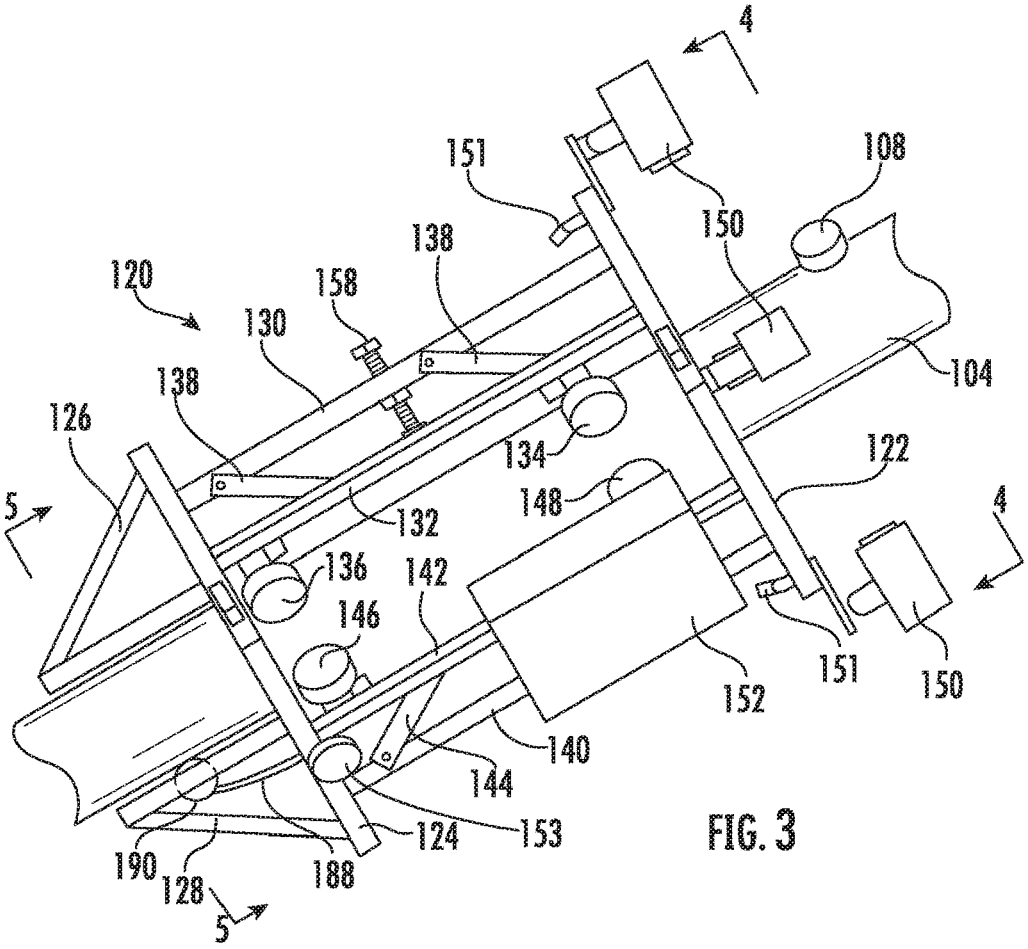
FIG. 3 is an elevational view of a cable stay transport vehicle of an inspection system.
Figure 4:
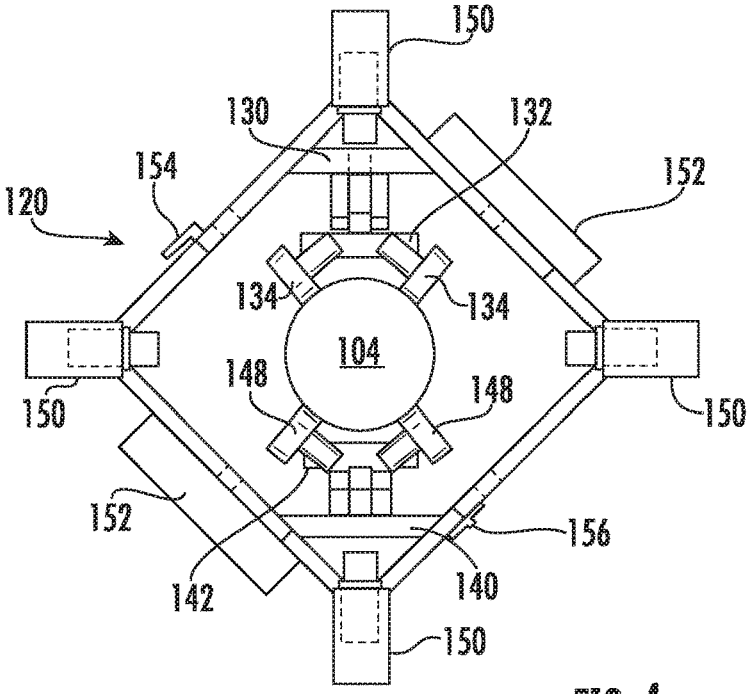
FIG. 4 is a top view of the transport vehicle taken in the direction of line 4-4 of FIG. 3.

An elevational view of a cable stay transport vehicle 120 is shown in FIG. 3. The transport vehicle 120 is a comprehensive maneuverable inspection device that can travel up, down and around the cable stays 104. The transport vehicle 120 is configured to visually inspect the cable stays 104 and connections to the pier 102 (e.g., anchors points) of the bridge 100 and recording the inspection as well as providing in real time monitoring of the exterior surface of the cable stays 104 and their respective connections to the pier 102. The transport vehicle 120 may include a high definition multi-camera multiplexed video monitoring system (e.g., 1080i and 60 fps).

The transport vehicle 120 may include wireless communications equipment in order to receive command and control commands and also to wirelessly transmit video. The transport vehicle 120 may include one or more cameras 150 for inspection and also driving cameras 151. For example, the transport vehicle 120 may have driving cameras 151 mounted on an upper frame 122 that are configured for monitoring of the movement of the transport vehicle 120 on the cable stays 104 and to avoid obstacles such as the grout ports 108. As explained above, the grout ports 108 are ports on the cable stay 104 that allow filling the cable stay 104 with a cement mixture referred to as grout.

Additional cameras 150 are used for inspection and may be aimed down onto the cable stay 104 and are responsible for a viewing angle of the cable stay 104 that exceeds 90 degrees. This allows for a full 360 degree view of the cable stay 104. The output of the respective camera 150 may be High Definition Multimedia Interface (HDMI) to provide high quality moving images (video) and a high quality video recording (e.g., 1080i and 60 fps). The camera lens zoom and focus features are typically fixed but may be variable. In addition, each of the cameras 150 are mounted on an angle adjustment mechanism that allows the respective camera 150 to pivot up and down. Thus, the cameras 150 can provide a view that can assist in navigation and view the cable stay 104 and pier connection anchor point that the transport vehicle 120 cannot fully reach. As explained above, the point where the cable stay 104 connects to the pier 102 is called the anchor point. The pivoting cameras 150 are adapted to tilt up and look ahead and visually inspect the cable stay 104 and also to inspect the anchor point on the pier 102. The control of the angle of the respective camera 105 may be accomplished by the remote controls 214, discussed below.

The transport vehicle 120 is configured to mount to a selected cable stay 104 and travel the length and circumference of the cable stay 104 while being fully controlled and monitored remotely. The wheels for the vehicle transport 120 may comprise rubber adapted for griping the cable stay 104 and for mobility. The wheels are configured to steer and navigate around the cable stay 104. The transport vehicle 120 is adapted to circumnavigate the cable stay 104 using the driving cameras 151 and is able to transverse the cable stay 104 up and down from the lower portion 110 to the upper portion 112 of the cable stay 104 by the rotation of the wheels.

As described below, electric motors that drive the wheels for the transport vehicle 120 may each include a pulse encoder that generates a pulse for each distance of rotation of the respective wheel. For example, the electric motor may generate a pulse for clockwise rotation that is different from counter-clockwise rotation. The pulses indicate a set distance traveled in order to calculate how far the transport vehicle 120 has traveled in a direction up the cable stay 104. The transport vehicle 120 is configured to gradually accelerate and decelerate in order to not spin the wheels. The angle that the cable stay 104 is mounted is a given parameter that can be used with the pulse signals in calculating the reference location of the transport vehicle 120 on the cable stay 104 at any given moment in time. Subsequently, it can be calculated how far the transport vehicle 120 has traveled in the horizontal direction for documenting any flaw or point of interest on the cable stay 104. In addition, where that flaw or point of interest is located is important for a maintenance vehicle to be able to park under that location for repair or further inspection using a bucket truck, for example. Accordingly, the horizontal location of the flaw or point of interest relative to the ground surface can be calculated based on the angle of the cable stay and distance of the flaw along the cable stay.

Figure 5:
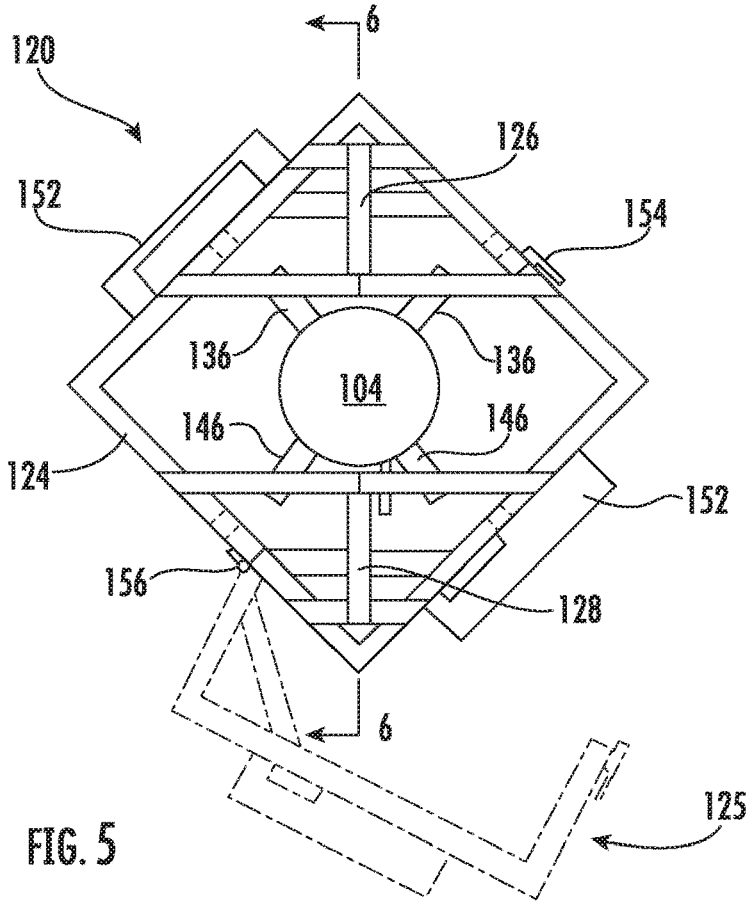
FIG. 5 is a bottom view of the transport vehicle taken in the direction of line 5-5 of FIG. 3.

The transport vehicle includes an upper frame 122 and a spaced apart lower frame 124. As shown in FIGS. 3-6, the transport vehicle is configured to be secured around a cable stay using the upper frame 122 and the lower frame 124 that are configured to swing open and closed about a hinge pin 156 in order to secure the transport vehicle around a cable stay 104 using a four step lockable handle 154. As shown in FIG. 5, element 125 illustrates how the frame can swing open to be secured around a cable stay 104.

The transport vehicle 120 includes left outer connectors 130 and left inner connectors 132 that connect a left side of the upper frame 122 to a left side of the lower frame 124. A left scissor truss 138 connects the left outer 130 and inner connectors 132 in an adjustable spaced apart relation. Similarly, right outer 140 and inner connectors 142 connect a right side of the upper frame 122 to a right side of the lower frame 124. A right scissor truss 144 connects the right outer 140 and inner connectors 142 in an adjustable spaced apart relation.

The transport vehicle 120 also includes left upper 134 and lower sets of wheels 136 secured proximate to upper and lower portions of the left inner connector 132, respectively, and each set of wheels is configured to be rotated to drive the transport vehicle 120 along a length of the cable stay 104. Similarly, right upper 148 and lower sets of wheels 146 are secured proximate to upper and lower portions of the right inner connector 142, respectively, and each set of wheels is configured to be driven independently in at least two directions. Accordingly, each set of wheels is configured to pivot to drive the transport vehicle 120 around a periphery of the cable stay 104 during an inspection.

Secured to the lower frame are left tail 126 and a right tail supports 128 that extend away from the lower frame 124 and provides additional protection as the transport vehicle 120 moves along the cable stay 104. In particular, the left and right tail section 126, 128 help guard the wheels from hitting a grout port or other obstacle on the cable stay. However, the left and right tail sections 126, 128 are removable and may be removed for particular cable stay inspections where obstacles such as grout ports are not on the cable stays.

Figure 6:
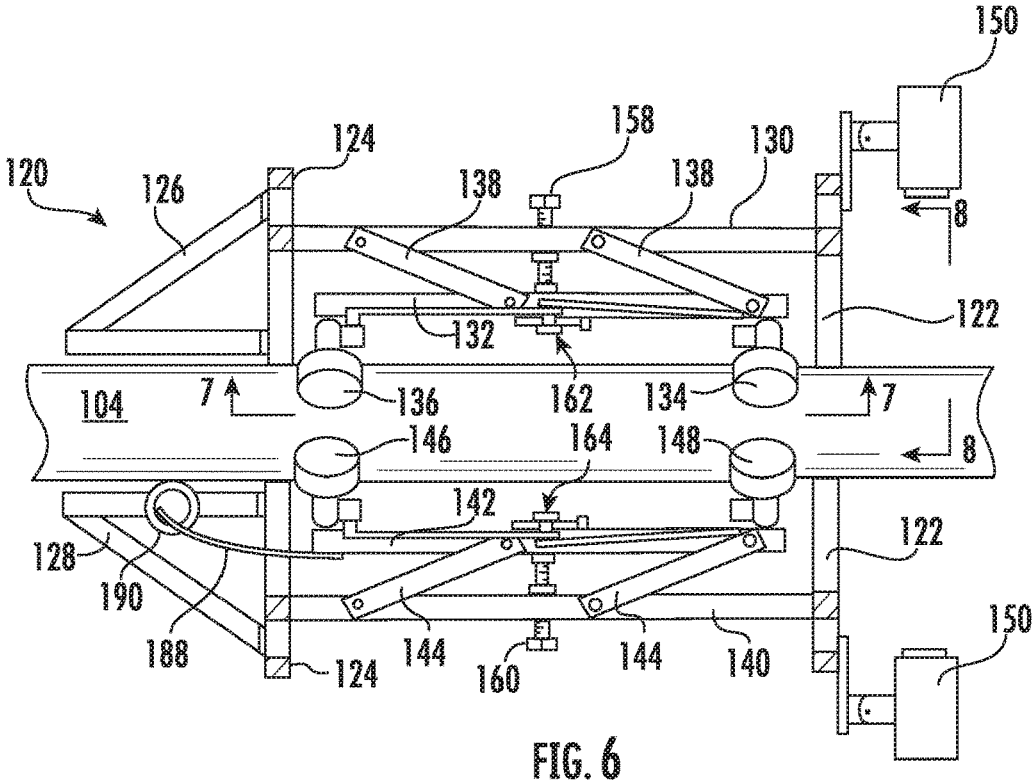
FIG. 6 is a partial elevational view of the transport vehicle taken in the direction of line 6-6 of FIG. 5.
Figure 8:
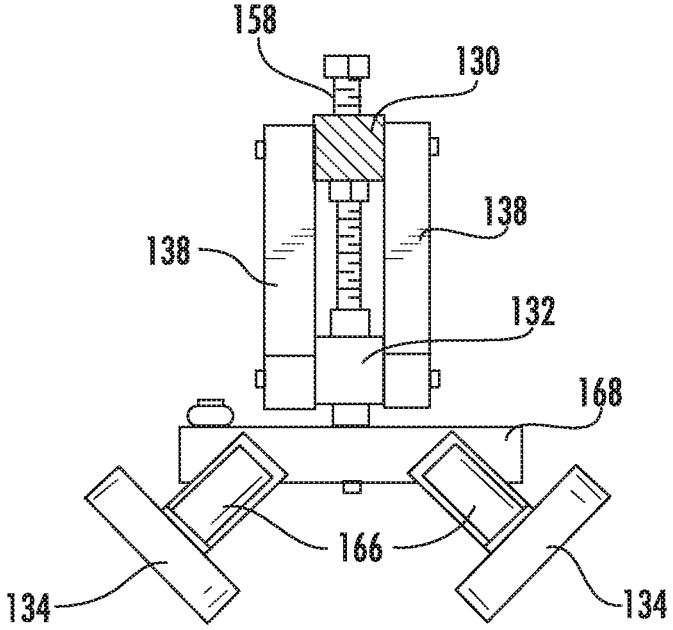
FIG. 8 is a partial top view of the transport vehicle taken in the direction of line 8-8 of FIG. 6.

As best shown in FIGS. 6 and 8, a left adjustment bolt 158 is coupled to the left outer 130 and inner connectors 132 and is configured to adjust a distance therebetween. As the left adjustment bolt 158 is rotated in a first direction, the left outer 130 and inner connectors 132 are forced apart. When the left adjustment bolt 158 is rotated in an opposing direction, the left outer 130 and inner connectors 132 move closer together. Likewise, a right adjustment bolt 160 is coupled to the right outer 140 and inner connectors 142 and is configured to adjust a distance therebetween. Through the adjustment of the left adjustment bolt 158 and the right adjustment bolt 160, the sets of wheels can be adjusted to make contact with the cable stay 104 having different dimensions.

At least one camera 150 is coupled to the transport vehicle 120 and configured to capture high quality images (e.g. 24 MP). In a particular embodiment there are four cameras 150 to provide overlapping coverage during the inspection. The transport vehicle may include a power supply 152 in electrical communication with the at least one camera 150 and each set of wheels 134, 136, 146, 148.

Figure 7:
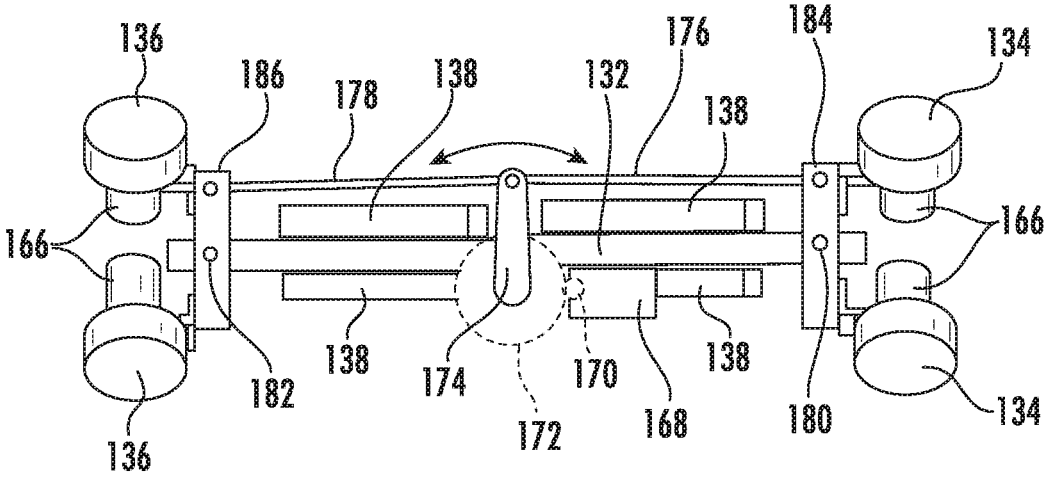
FIG. 7 is a partial elevational view of the transport vehicle taken in the direction of line 7-7 of FIG. 6.

Referring now to FIG. 7, the transport vehicle 120 includes a left steering device 162 coupled to the left upper 134 and lower sets of wheels 136. The transport vehicle 120 also includes a similar right steering device 164 coupled to the right upper 148 and lower sets of wheels 146. The left (and right) steering device 162 includes a left steering gear 172 coupled to a left steering linkage 174. As an example, the left steering linkage 174 is connected to the left steering gear 172 and has a first end 176 coupled to the left upper set of wheels 134 and a second end 178 coupled to the left lower set of wheels 136. The right steering device 164 includes the same elements as the left steering device 162 and they cooperate together to drive the transport vehicle 120.

In addition, the left 162 steering device includes a left driving gear 170 that is in engaged relation to the left 162 steering device. Accordingly, as the left driving gear 170 rotates, the left steering gear 172 is engaged and begins to rotate in an opposite direction from the left driving gear 170. This movement of the left steering gear 172 results in the first and second ends 176, 178 of the left steering linkage 174 pushing one set of wheels 134, 136 and pulling the opposing set of wheels 134, 136, and causing the respective set of wheels to turn about a center pivot.

For example, the upper set of wheels 134 are mounted to opposing sides of an upper strut 184, where the upper strut 184 is mounted perpendicular to the upper end of the left inner connector 132 using a left upper pivot pin 180. Similarly, the lower set of wheels 136 are mounted to opposing sides of a lower strut 186, where the lower strut 186 is mounted perpendicular to the lower end of the left inner connector 132 using a left lower pivot pin 182.

Each of the sets of wheels have an electric motor 166 that is responsive to remote controls. In addition, an electric steering motor 168 is responsive to the remote controls and is used to drive the respective driving gear (e.g., 170).

The transport vehicle 120 may also include a spring 188 and a spring loaded wheel 190 secured proximate to a lower portion of the right inner connector 142 and biased to maintain contact with the cable stay 104. The spring 188 forces the wheels of the transport vehicle 120 to make secure contact and to the cable stay 104.

Figure 9:
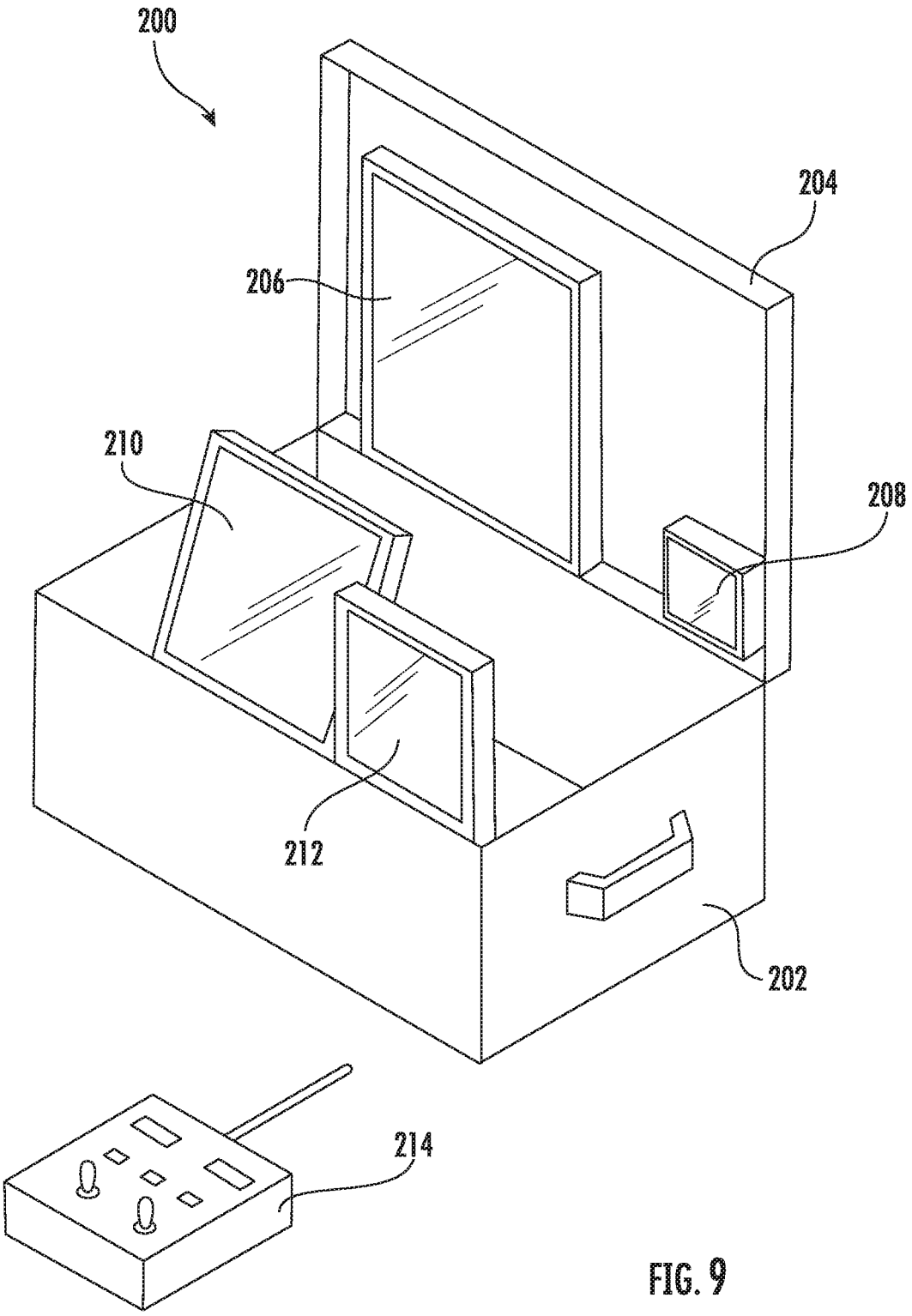
FIG. 9 is a perspective view of a command and control system for the transport vehicle.

Referring now to FIG. 9, a command and control system 200 is shown that is used in cooperation with the transport vehicle 120 and the cameras 150, 151. In a particular embodiment, the controls are wireless controls 214 that transmits signals to the transport vehicle 120. For example, wireless signals may be transmitted to the sets of wheels to drive forward or in reverse, and to cause the sets of wheels to turn using the respective steering devices described above. In addition, the electric motors 166 coupled to each of the set of wheels, may be configured to generate a signal correlating to a distance along the cable stay 104 that the transport vehicle moves 120. This signal can be transmitted back to the control and command system 200.

The command and control system 200 may include a base 200 housing several video monitors 206, 108, 210, 212, that are used for displaying images from the video cameras 150, 151 mounted to the transport vehicle 120. The base 200 may have lid 204 or cover that can be closed when transporting the command and control system 200. The wireless video capability of the inspection system allows the transport vehicle 120 to transmit a wireless multiplexed output of the four cameras 150 through a wireless RF digital video transmitter. The multiplexing of the four cameras 150 allows all the cameras 150 to be transmitted in one signal. The multiplexer may be part of one or more the cameras 150. Images from driving cameras 151 may be displayed separately from the cameras 150 used for inspection. Accordingly, the operator can use the display for the driving cameras 151 in order to drive the transport vehicle 120 up and down the cable stay, while the cameras 150 are used to record images of the inspection of the cable stay. The signal for the driving cameras 151 may also be transmitted with the wireless multiplexed output from the cameras 150, along with a telemetry signal for information of the location of the transport vehicle 120 along the cable stay 104 and also along the bridge deck. Knowing the location along the bridge deck relative to the cable stay 104 allows a worker to know where to position a bucket truck under the cable stay 104 in order to perform a repair, for example.

In operation, the transport vehicle 120 is latched around a cable stay 104. The left adjustment bolt 150 and the right adjustment bolt 160 are adjusted to confirm the attachment of the transport vehicle 120 to the cable stay 104 is sufficient. The transport vehicle 120 is then powered up. The transport vehicle 120 is configured to perform a short diagnostic to insure that the communications are working and that the mechanical robotics are functional and remote controllable.

The next step is to make sure all cameras 150 are moving and controllable. Once the cameras are confirmed to be online, the cameras 150 are aligned onto the cable stay 104. This is to confirm that 360 degrees of the cable stay 104 is visible. The next step is to confirm that the video is of high quality from all the cameras 150. The cameras 150 should also be consistent from one to the other. If a camera is out of compliance, that camera is replaced with a replacement of the same model. Once all the cameras 150 are operational, a record unit of the command and control system 200 is activated and the transport vehicle 120 is checked for maneuverability up, down and around the cable stay 104. Once all functionalities are confirmed, then the recording is checked for performance and quality. In addition, the power system is checked for appropriate amps and voltage. The driving cameras 151 are also checked before deployment up the cable stay 104.

The transport vehicle is then deployed up the cable stay 104 towards the upper end 112 of the cable stay 104 while remaining aware of the locations of the grout ports 108. If a grout port 108 is encountered, the cameras 150 are configured to tilt up to help in the maneuvering around the grout port 108. There may be additional driving cameras 151 that are mounted on the transport vehicle 120 specifically for monitoring obstacles and grout ports 108 when driving the transport vehicle 120. There may at least one driving camera 151 pointed towards the front of the transport vehicle 120 in order to see ahead along the cable stay when the transport vehicle 120 is traveling up the cable stay. Likewise, there may at least one driving camera 151 facing towards the rear of the transport vehicle 120 in order to see back down the cable stay when the transport vehicle 120 is headed back down the cable stay to the ground.

When the transport vehicle 120 reaches an end point, the cameras 150 are then tilted up to view and record the status of the anchor point and pier connection. Movement of the transport unit 120 is paused while the recorded video is reviewed for any points of interest or to determine if the video is missing an area of the cable stay 104. The transport vehicle 120 is then monitored and any additional areas recorded as the transport vehicle travels downward back to the lower end 110 of the cable stay 104.

If a point of concern or a fault is found on the cable stay 104, the location is recorded and also can be noted on the ground directly below the problem area. Once the transport vehicle 120 has finished the inspection and is back to the point that it was mounted, the transport vehicle 120 can be removed and prepared to be mounted to the next cable stay.

An advantage of the cable stay transport vehicle and inspection system described above is that the transport vehicle 120 is robotic and is able to maneuver around obstacles and the grout ports 108 which protrude out of the cable stays 104. The transport vehicle 120 has sufficient gripping power to maintain a solid and consistent connection between the cable stay 104 and the wheels that travels up the cable stay 104. Another advantage of the transport vehicle 120 is that it has the ability to indicate its vertical and lateral position on the cable stay 104 at any point in time in order to coordinate the video and document any faults.

Figure 10:
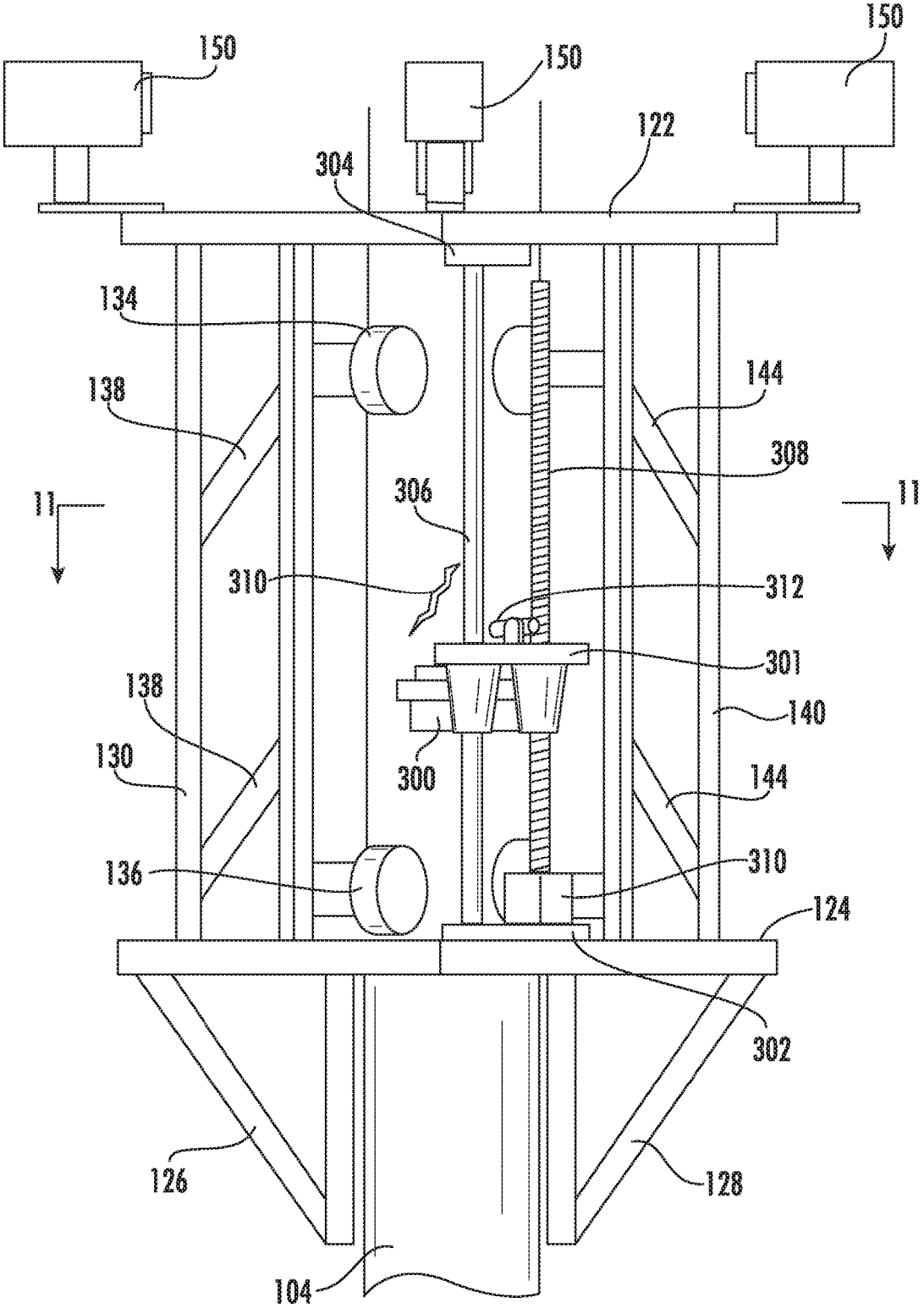
FIG. 10 is an elevational view of the transport vehicle fitted with a LIDAR unit.
Figure 11:
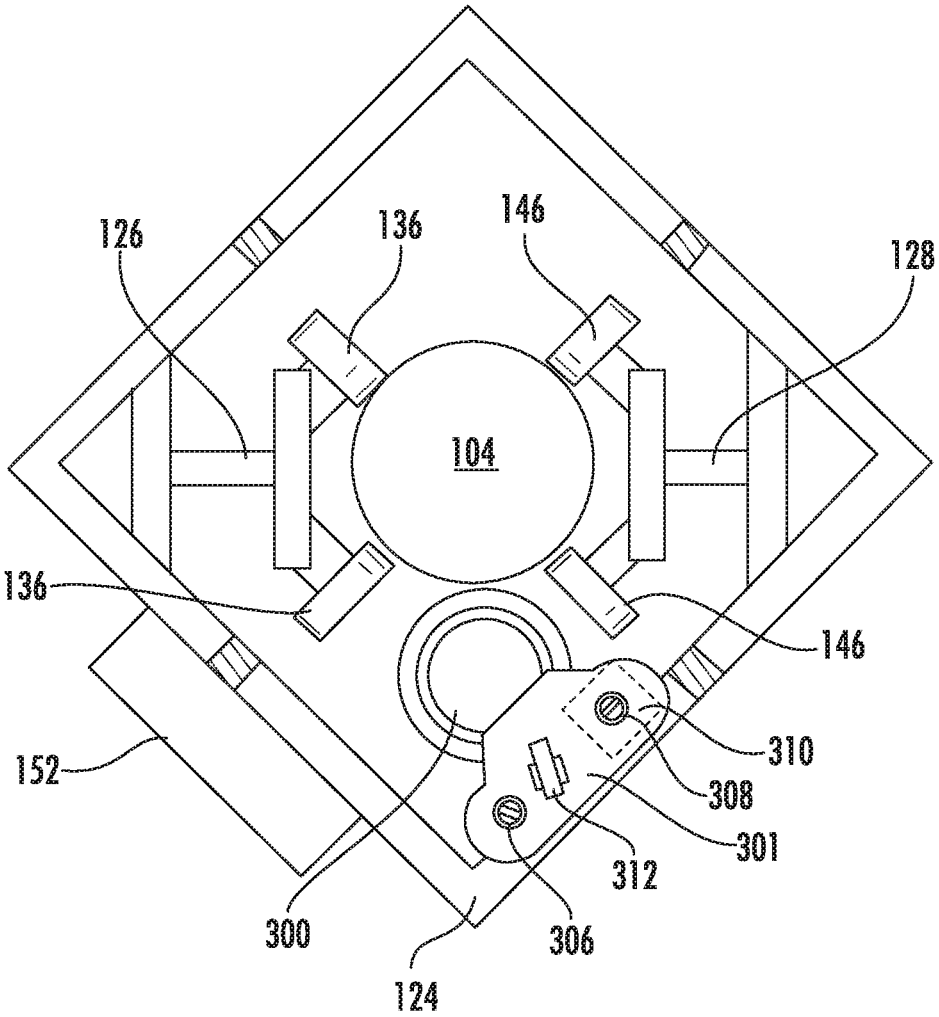
FIG. 11 is a partial top view of the transport vehicle and LIDAR unit taken in the direction of line 11-11 of FIG. 10.

Referring now to FIGS. 10 and 11, the transport vehicle has been fitted with a LIDAR unit 300. The LIDAR unit 300 is installed between the upper frame 122 and the lower frame 124. A lower pad 302 is secured to the lower frame 124 and an upper pad 304 is secured to the upper frame 122. A support rod 306 has its respective ends secured to the lower and upper pads 302, 304, and the support rod passes through a housing 301 secured directly to the LIDAR unit 300. In addition, a lower end of a threaded rod 308 is rotatably mounted to an electric motor 310 secured to the lower pad 302, and the electric motor 310 is configured to rotate the threaded rod 308. The threaded rod 308 extends through the housing 301 towards the upper frame 122. As the threaded rod 308 is rotated by the electric motor 310, the housing 301 of the LIDAR 300 moves along the threaded rod 308. Accordingly, when an area of interest on the cable stay 104 is detected, the LIDAR unit 200 can be positioned over the area of interest using a locating camera 312 mounted to the housing 301. The LIDAR unit 300 is configured to determine a depth of a crack 310, for example, and transmit the information back to the command and control system 200.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A cable stay transport vehicle and inspection system, the transport vehicle comprising:

an upper frame and a spaced apart lower frame, the transport vehicle configured to be secured around a cable stay;

left outer and inner connectors connecting a left side of the upper frame to a left side of the lower frame;

a left scissor truss connecting the left outer and inner connectors in an adjustable spaced apart relation;

right outer and inner connectors connecting a right side of the upper frame to a right side of the lower frame;

a right scissor truss connecting the right outer and inner connectors in an adjustable spaced apart relation;

left upper and lower sets of wheels secured proximate to upper and lower portions of the left inner connector, respectively, and each set of wheels configured to be rotated to drive the transport vehicle along a length of the cable stay;

right upper and lower sets of wheels secured proximate to upper and lower portions of the right inner connector, respectively, and each set of wheels configured to be driven independently in at least two directions;

a left adjustment bolt coupled to the left outer and inner connectors and configured to adjust a distance between therebetween;

a right adjustment bolt coupled to the right outer and inner connectors and configured to adjust a distance therebetween; and at least one camera coupled to the transport vehicle and configured to capture images.

2. The cable stay transport vehicle and inspection system of claim 1, wherein each set of wheels is configured to pivot to drive the transport vehicle around a width of the cable stay.

3. The cable stay transport vehicle and inspection system of claim 1, the transport vehicle comprises a power supply in electrical communication with the at least one camera and each set of wheels.

4. The cable stay transport vehicle and inspection system of claim 1, the transport vehicle comprises a left steering device coupled to the left upper and lower sets of wheels.

5. The cable stay transport vehicle and inspection system of claim 4, the transport vehicle comprises a right steering device coupled to the right upper and lower sets of wheels.

6. The cable stay transport vehicle and inspection system of claim 5, wherein the left steering device comprises a left steering gear coupled to a left steering linkage, the left steering linkage having a first end coupled to the left upper set of wheels and a second end coupled to the left lower set of wheels.

7. The cable stay transport vehicle and inspection system of claim 6, wherein the right steering device comprises a right steering gear coupled to a right steering linkage, the right steering linkage having a first end coupled to the right upper set of wheels and a second end coupled to the right lower set of wheels.

8. The cable stay transport vehicle and inspection system of claim 7, wherein the left and right steering devices comprise left and right driving gears being in an engaged relation to the left and right steering devices, respectively.

9. The cable stay transport vehicle and inspection system of claim 1, the transport vehicle comprises a spring loaded wheel secured proximate to a lower portion of the right inner connector and biased to maintain contact with the cable stay.

10. The cable stay transport vehicle and inspection system of claim 1, further comprising remote controls in wireless communication with the transport vehicle configured to control each set of wheels.

11. The cable stay transport vehicle and inspection system of claim 1, the transport vehicle comprises an electric motor coupled to each of the set of wheels, and configured to generate a signal correlating to a distance along the cable stay that the transport vehicle moves.

* * * * *